US005863314A

United States Patent [19]

Morando

[11] Patent Number: 5,863,314

[45] Date of Patent: Jan. 26, 1999

[54] MONOLITHIC JET COLUMN REACTOR PUMP

[75] Inventor: Jorge A. Morando, Grosse Ile, Mich.

[73] Assignee: Alphatech, Inc., Trenton, Mich.

[21] Appl. No.: 733,078

[22] Filed: Oct. 16, 1996

Related U.S. Application Data

[63] Continuation-in-part of Ser. No. 489,322, Jun. 12, 1995, Pat. No. 5,683,650, and a continuation-in-part of Ser. No. 529, 683, Sep. 18, 1995, Pat. No. 5,639,419, and Ser. No. 560,661, Nov. 20, 1995, Pat. No. 5,650,120.

[51] Int. Cl.[6] ..... C21B 3/04

[52] U.S. Cl. ..... 75/708; 266/228

[58] Field of Search ..... 75/706, 708; 266/228, 266/227

[56] References Cited

U.S. PATENT DOCUMENTS 5,203,910 4/1993 Areaux et al. ..... 75/708

5,360,204 11/1994 Mancuso ..... 266/228

5,395,094 3/1995 Areaux ..... 75/708

OTHER PUBLICATIONS

Molten Aluminum Pumping and Hydrogen Removal by Gas Lift: Water Model Studies and Preliminary Molten Aluminum Experience By: Frede Frisvold, Thorvald A. Engh, Didrik S. Vess. Dec. 1995.

Liquid Gas Two Phase Flow Theory of Jet Pump By: Lu Hongi, Apr. 1983.

Bubble Column Reactors By: Wolf–Dieter Deckwer Dec. 1992.

*Primary Examiner*—Scott Kastler
*Attorney, Agent, or Firm*—Charles W. Chandler

[57] ABSTRACT

A jet column reactor apparatus for moving molten metal in a bath of such metal is formed with a monolithic refractory body.

36 Claims, 9 Drawing Sheets

MONOLITHIC JET COLUMN REACTOR PUMP

CROSS-REFERENCE OF RELATED APPLICATIONS

This application is a continuation-in-part of U.S. patent application Ser. No. 08/489,322, now U.S. Pat. No. 5,683,650 filed Jun. 12, 1995, for a Bubble Apparatus for Removing and Diluting Dross in a Steel Treating Bath; Ser. No. 08/529,683, now U.S. Pat. No. 5,639,419, filed Sep. 18, 1995, for a Bubble Operated Dross Diluting Pump for a Steel Treating Bath; and Ser. No. 08/560,661, now U.S. Pat. No. 5,650,120, filed Nov. 20, 1995, for a Bubble Operated Recirculation Pump for a Metal Bath.

BACKGROUND AND SUMMARY OF THE INVENTION

Transferring liquids such as chemicals, effluents, or molten metals by using multi-phase flow technology is known in the art. Practically everything and every conceivable concept, as well as all the related theories for their design, reaction, modeling, gas absorption, heat transfer, etc., has been covered with infinitesimal detail in the book by Wolf Dieter Deckwer, first published under the title *Reacktion-technik in Blasensäulen,* Copyright 1985, Otto Salle Verlag GmbH & Co., Frankfurt am Main, Verlag Sauerländer AG, Aarau, Switzerland. Additional studies have been conducted by Frede Frisvold, Thorvald A. Engh, and Didrik S. Voss as early as 1985.

The earliest systematic investigation of a multi-phase (gas/liquid) pump began in 1968, by Lu Hongqi and Liang Zhongtian, Wuuhan Institute of Hydraulics and Engineering, Peoples Republic of China, who have through the years proposed the basic theoretical equations and boundary condition equations that govern two-phase flow utilizing flow models. Using the extensive knowledge available, some designs have been proposed to pump molten metals. Among them, Alphatech/Alcoa, tested bubbling gas (nitrogen) inside tubes to generate metal motion, and analyzed the mixing of nitrogen in the liquid metal for the purpose of removing hydrogen entrapped in the liquid metal as early as August of 1990.

Later, Larry D. Areaux and Brian Klenoski were issued U.S. Pat. No. 5,203,910, Apr. 20, 1993, in which the vertical column suggested by Wolf Dieter Deckwer was replaced by an inclined column to effect the recirculation. See FIGS. 17 and 18.

In plants where aluminum scrap is melted converting the metal to liquid aluminum and then to cast products, it is customary to prepare alloys in batches of 50 tons or more. The composition and temperature of the liquid metal must be closely controlled. Predictable metal temperature means predictable timing and it becomes possible to schedule a greater output with less capital expenditure. These furnaces are fired with natural gas or fuel oil.

The inventive equipment obtains temperature and alloy homogeneity in the furnace, and provides a method for stirring the liquid metal to equalize the temperature in the furnace, and eliminating the thermal gradients in the liquid metal to optimize the alloying elements dissolution rate. The preferred method removes undesirable gasses entrapped in the aluminum melt by impinging inert gas at high velocity during the recirculation process. A method is disclosed for manufacturing this equipment to maximize its reliability, integrity, and life to withstand the rigorous environment and treatment to which it is subjected. Further, a method is disclosed for recovering the inert gas from the equipment, in order to minimize additional expense.

As the density of aluminum decreases with increasing temperature, the application of heat over the metal pool in the furnace produces a transient thermal gradient. When the pool depth in the furnace is approximately 36" and the pool is heated from above, approximately 30 minutes elapses before that heat reaches the bottom of the furnace. Because of aluminum's high reflectivity there is very low observable liquid metal convection. The heating rate of 50 tons of metal is in the vicinity of 106° F. in half an hour. Therefore the bottom temperature lags by half an hour. Gradients develop which approach 200° to 250° from the top to the bottom of the melt.

To overcome the temperature control problem, to reduce energy consumption and to improve the reliability of alloying, forced stirring, or metal recirculation, of the melt is necessary. Electromagnetic and mechanical means are possible.

Electromagnetic means is ruled out because of the incredible installation costs. Mechanical means require a pump well outside the furnace proper, which further cools the molten metal, and introduces additional energy loss. The mechanical pumps currently used are subject to continuous failures and very high maintenance costs because of the severe environment. The inventive pump can be introduced into such a furnace below the metal line to effectively mix large tonnages of liquid metal while firing the furnace, thus permitting good temperature control, and fuel and time economy.

If a continuous jet of liquid is injected into a body of that liquid, then Fox and Gex (A.I.C.H.E. Journal 2.4.1956. Pg. 539) have shown that the mixing time of the body is given by:

$$t_m = C_1 \frac{Y^{1/2} Dt}{(N_{re})^{1/6}} \cdot \frac{1}{(V_o D_o)^{2/3}} \cdot \frac{1}{Y^{1/6}}$$

where $$N_{re} = \frac{V_o D_o}{U}$$

Y=depth of the body of liquid $D_t$=diameter $N_{re}$=Reynolds number of the liquid U=Kinematic viscosity of the liquid G=gravitational acceleration $V_o$=jet velocity $D_o$=jet diameter When the properties of the tank and the fluid are constant, $$t_m = C_1 \frac{C_2}{N} \cdot \frac{1}{(V_o D_o)^{5/6}}$$

where N is the number of molten metal jets used.

A single jet pump inserted into a bath of aluminum inside the furnace has, (see FIGS. 23 and 24) when providing suitable mixing, the advantage of extreme simplicity (no moving parts immersed in the liquid aluminum).

The problems with prior art devices which move molten metal in a bath using two-phase flow technology is that the designs use bubble-lifting technology, which is extremely slow, has very poor effective gas distribution, poor gas dispersion in the metal and low flow velocity. The Areaux et al. design is aggravated by the inclined tube configuration.

The operating efficiency and maximum velocity of a bubble pump reactor is obtained when the tube is vertical, since the head lifting capacity of the pump is dictated by the height of the molten metal pool. The bubble has to travel a longer distance in an inclined tube, thus increasing the time to reach the surface, and, consequently, reducing the velocity of the metal flow and the efficiency of the pump. It is also obvious by examining the Fox Gex equation that the velocity of the liquid aluminum stream inserted into the aluminum melt as well as the cross-sectional area of the stream should be as large as possible, since the time required to equalize the temperatures is inversely proportional to these two factors. Obviously, bubble column pumps do not have these attributes.

Another detrimental characteristic of the Areaux et al. bubble design is that the nitrogen gas is injected in the inclined tube perpendicular to the direction of metal flow. This is necessary to avoid additional severe complications in the design and manufacture of the inclined tube pump. Because of this, the injected gas acts as a fluidic restrictor, or shut-off valve (see FIG. 18) that prevents the metal from either flowing in the direction of the tube or entering the tube since the gas injected at the bottom of the tube is trying to expand in both directions.

An additional detrimental characteristic of the inclined tube bubble pump is that it forms elongated bubbles because they are trying to expand vertically toward the surface faster than toward the inclined outlet of the tube, thus creating a large back-flow of metal that reduces the pump efficiency to ranges well below 20%, (see FIG. 17). In addition, to allow the necessary time to generate a large enough bubble to seal the inclined tube and to keep the gas from impinging against the opposite wall of the tube and creating severe material damage because of the cavitation and erosion effect created, the inlet pressures that can be applied must be maintained far below sonic ratios.

Tests conducted by the writer on a typical inclined tube bubble pump of 2½" diameter and a 45° angle show that the inlet pressure could not be below a P2/P1=0.83, where:

P2=absolute outlet pressure (usually ~18.3 PSIA); and

P1=absolute inlet pressure

At P2/P1 ratios below 0.83, the gas started exiting toward the lower end of the tube, stopping all possible flow for tubes inclined to a 45° angle (see FIGS. 17 and 18). In other words, the gas inlet pressure for most furnace applications could not exceed 22.0 PSIA (7.3 PSIG). To achieve gas sonic velocity in a nitrogen gas flow process (K=1.4), the ratio P2/P1 must be maintained below 0.528 which will require a gas inlet pressure of 34.65 PSIA (19.95 PSIG) minimum, almost three times the maximum of an inclined tube bubble pump. This is not improved by pulsating the gas input since the average velocity of the gas and the metal remain almost unchanged and extremely slow. In tests conducted, the maximum metal flow velocity obtained was 12 to 14 in/sec, while the minimum required for a proper recirculation/degassing unit should be no less than 40 in/sec. A standard motor-driven recirculation pump has a metal flow velocity of approximately 40 to 60 in/sec. Based on the available test data, it can be stated that the maximum gas flow velocity in an inclined tube bubble pump will be approximately 112 ft/sec. The sonic flow velocity of nitrogen under the conditions stated (aluminum temperature 1740° R., P2=18.3 PSIA), $$\frac{P_2}{P_1} < .528 \therefore P_1 \geqq 35.0\ PSIA \quad Vgs \cong 569\ \text{ft/sec}$$

This is 5 times the maximum inlet velocity achievable on an inclined tube bubble pump with radial gas injection. Obviously, Areaux et al. have been extremely optimistic in the assessment of the performance of their pump.

Therefore, the bubble pump design is not an efficient recirculator degasser or dross emulsifier because effective recirculation velocity, degassing and dross emulsifying is only obtained by injecting the gas into the molten metal at the highest possible velocity (sonic or nearly sonic), in order to obtain the maximum possible metal flow velocity and gas dispersion into the metal for optimum removal of the entrapped gasses. When a high level of gas dispersion and flow velocity is the end result of forced liquid recirculation, the utilization of gas jets oriented centrally and axially in the direction of the metal flow is absolutely mandatory. The pumping of metal by the slow formation of large bubbles does not provide any of the basic stated requirements.

The design of multiple central axial jet gas injection distribution with an elliptical cross-section in the metal-lifting conduit, as shown in FIGS. 5 and 6, was disclosed in my patent application Ser. No. 08/560,661, filed Nov. 20, 1995, for a jet bubble-operated recirculating pump for a metal bath.

Because of the inclined tube's configuration, the Areaux et al. multiple porting gas injection does not work because it aggravates the fluidic shut-off valve effect. In my design (see FIGS. 5 and 6), the power jets create a high energy dissipation zone in which the gas is broken up into very small primary bubbles. The bubbles then coalesce to form large bubbles. An equilibrium bubble diameter is established that remains the same throughout the remainder of the conduit.

The extent of the coalescence and size of the bubbles at the equilibrium zone depends on the number of nozzles, the inlet and outlet pressures, the head of metal above the gas injection point and the liquid metal properties. Although the design in FIGS. 5 and 6 already presents great advantages with respect to efficiency, flow velocity and gas dispersion over that of an inclined tube design, testing and analyses conducted by the applicant confirm that additional compression of the gas into the liquid metal is required to achieve true degassing and high flow velocities that are not totally dependent on the liquid metal head above the pump.

Based on these evaluations, the pump configuration shown in FIGS. 2 and 3 has been created. A convergent/divergent nozzle zone feature has been added to the pump's vertical section, since in a jet column reactor the metal flow velocity and gas dispersion are not a function of the metal head above the pump. This assures, by accelerating the metal at the throat section of the tube nozzle, that a faster intermixing and a forcing of the gas dispersion into the metal will take place, retarding the gas coalescence and tendency to aggregate too soon into larger bubbles. The metal conduit nozzle area to throat area ratio is the most important design element for jet pumps and serves as a criterion in the same manner as specific speed does for centrifugal pumps (J. J. Whitte "Efficiency and Design of Liquid Gas Ejectors", British Chemical Engineering, Vol. 9, September 1965). Theoretical studies performed by Lu Hongqi indicate that this type of pump, when properly designed, should provide a higher velocity at a given flow than any centrifugal pump. With an output head 50% higher than that of a centrifugal pump, this translates into a proportional increase in outlet velocity.

$$\left( H_o = \frac{V^2}{2g} \text{ or } V = \sqrt{2gH_o} \right)$$

This steep head capacity characteristic was corroborated in water testing by R. G. Cunningham, (*Gas Compression with a Liquid Jet Pump,* Journal of Fluids Engineering Transactions, A.S.M.E., Serial 1,96,3, September 1974). As there is a true two-phase flow, a unit weight of the liquid (molten metal+gas) is very different from that of the gas and that of the molten metal. The evaluation of the flow pattern is highly complex. The performance of what I call the "jet column degassing and dross diluting reactor" is related to the type of the conduit structure ("S", "C", "L", "T" and "U" shapes in this patent application, see FIGS. 2–5 and 19–21), number of gas injecting nozzles, inlet/outlet pressure ratio and physical orientation.

Another great difference exists between my inventive design and standard bubble column pumps because my pump will operate in any position (from horizontal to vertical) and generate flow upwards or downwards without a loss of efficiency, (see FIGS. 19–21), since it utilizes the energy transfer from the gas to the liquid, acting as a flow transfer machine and mixing reactor. Bubble pumps only flow upwards (inclined or vertically), and their efficiency is a function of the angle of inclination. Bubble pump designs only utilize the energy provided by the head of metal above the point of gas injection. If the column in a bubble pump, instead of being inclined, is in a horizontal position, the output and efficiency of the bubble pump would be zero ($\Delta H=0$). The transfer of energy in my pump, from the gas and its momentum to the liquid metal, is effected by the convergent/divergent nozzle provided on the straight portion of the "S" or "C" shapes, or the horizontal section shown in the "T" and "U" configuration (see FIGS. 2, 3, 5, 8, 19 and 21).

The general description of the operation of my inventive pump, as shown in FIGS. 2 and 3, can be broken into the following stages:

1. The flow between the gas jet and the suction of liquid metal is relative in motion, in which the liquid metal is sucked by the gas jet boundary with a transfer of momentum from the gas to the liquid. At this stage, the liquid and the gas are considered separate mediums.
2. Under the action of the boundary gas jet velocity, the gas is broken into very small bubbles that are distributed in the liquid. As the bubbles impact the liquid molecules, the gas is compressed in the convergent zone of the nozzle and dispersed in the liquid.
3. The gas bubbles are surrounded by liquid drops. The liquid drops coalesce into a mixture with the bubbles trapped in it, carried forward and further compressed. In this stage the liquid is considered the continual medium and the gas is distributed in the liquid as bubbles.

There has been a stage of semi-experiment and semi-theory in the study of liquid/gas jet pumps, mostly where the element injected at sonic velocity is the liquid, and the gas is provided for the purpose of dispersion because of its flammable, explosive or radiation condition. In my inventive pump, the liquid is in a metal pool, and the gas media is injected at near sonic or sonic velocity through the use of multiple nozzles centrally and coaxially aligned with the straight section of the "S" or "C" shaped conduit. Some of the formulations obtained by Lu Hongqui (the equations and critical flow conditions) have been used to size the experimental pumps. Verification of liquid metal flow and degassing efficiency were performed in both water and molten metal (aluminum), starting in November of 1994. For additional views of the "S" shaped and "C" shaped configurations, refer to FIGS. 3–8, 25 and 26.

My inventive pump also addresses the breakage and erosion problems encountered with pumps moving molten metals for recirculation or degassing purposes. A pump made of a relatively thin-walled ceramic material has been disclosed in my U.S. patent application Ser. No. 08/560,661, filed Nov. 20, 1995, for a bubble-operated recirculation pump for a metal bath. The problem with a thin-walled ceramic device is that, although it is extremely resistant to erosion and corrosion from either the liquid metal or the dross in the metallic bath, the device is brittle and generally breaks when mistreated by the furnace operators. For example, when the furnace metal pool is loaded with solid metal ingots, the impact from one of these ingots can permanently damage a relatively fragile pump.

My improved pump encases the basic pumping conduit in a refractory body (see FIGS. 9 and 10). A ceramic conduit is placed in a box or mold and encased in a refractory mix after which it is fired dry in a kiln. Both the nitrogen feeding conduits and the thin-walled lifting conduits are then firmly encased in refractory material, thereby eliminating the possibility of breakage of the ceramic material. Tests conducted with this configuration show excellent life and impact resistance.

The preferred embodiment of my invention can also be made with a refractory body, without the use of a liner, by the well-known lost-wax method or other similar methods, where the pattern core is dissolved or melted. A device having no liner is especially useful in a zinc bath. The refractory material is basically a combination of alumina and silica and extremely resistant to molten zinc or zinc/aluminum alloys where the percentage of aluminum is below 25%. On the other hand, in an aluminum bath, aluminum is known to attack the silica material by alloying itself with the silicon in it and releasing the oxygen, forming dross that clogs the lifting conduit. For these particularly high aluminum alloys or aluminum applications, the refractory should be silica-free alumina.

A monolithic casting with a ceramic liner is not only extremely inert to aluminum attack up to temperatures in the order of 2000° F.; but, in addition, it is very durable, hard and abrasion resistant to impurities carried by the molten metal. It can withstand severe cavitation problems that could be created by an improper lifting conduit configuration (inclined tubes with sharp turning corners as depicted in the Areaux et al. bubble pump patent (see FIG. 17), where a sharp transition from the inclined to the horizontal is prone to create severe cavitation damage in the tube, be it ceramic or any other material).

An additional advantage of my inventive reactor pump is that by utilizing my monolithic jet column degassing and dross diluting reactor, the conventional outside pumping well of recycling furnaces can be eliminated by recirculating the metal inside the furnace bath by installing a "C" shaped configuration jet column reactor in each corner of the furnace (see FIG. 15). The scrap can be loaded in the recycling furnace directly through a funnel conduit, minimizing heat loss and maximizing energy efficiency. The outside well needed for installation of the recirculation and degassing pump is eliminated (see FIG. 16).

Another application and advantage of the "C" shaped jet column reactor is that in the zinc and aluminum baths in the galvanizing industry, the dross comprising iron, aluminum and zinc/aluminum sinks to the bottom of the pot. This dross accumulates to the point where it touches the sink roll, around which the strip being galvanized is passing, thereby contaminating the strip and, on some occasions, completely stopping the rotation of the roll.

The advantage of my monolithic pump configuration is that, when placed at the bottom of the pot, it can be used to continuously recirculate the bottom dross. The jet gas disperses it into the liquid metal to prevent build-up. Preferably the bottom of the galvanizing pot is formed with a low spot, so the bottom dross will tend to concentrate at a location where it can be easily sucked in through the bottom inlet of my jet column reactor.

Yet another advantage of the jet column reactor is that the metal, gas flow velocity and gas dispersion capacity is not a function of the metal head above the pump. By increasing the pressure ratio between inlet and outlet to sonic (P2/P1<0.528), dross that has already been crystallized will become emulsified and its density reduced, generating a tendency for it to float. The floating dross can then be easily skimmed off the bath (see FIG. 19 and 26).

The preferred device, as shown in the drawings, uses a multi-orifice/nozzle (nitrogen, argon or helium feed) arrangement. Several small orifices are necessary and advantageous over a single large orifice because a very small high velocity jet generates bubbles which expand very fast past the nozzle throat, due to surface tension and the differential pressure between the gas and the metal. As the bubbles increase in diameter, they expand slower, reducing the total area exposed to contact with the metal and reducing the degassing ability of the pump (Sigworth G. K., 1982, "Hydrogen Removal from Aluminum", Meeting Trans. B, vol. 13B, pp 447–460).

DESCRIPTION OF THE PREFERRED EMBODIMENT

Figure 2:
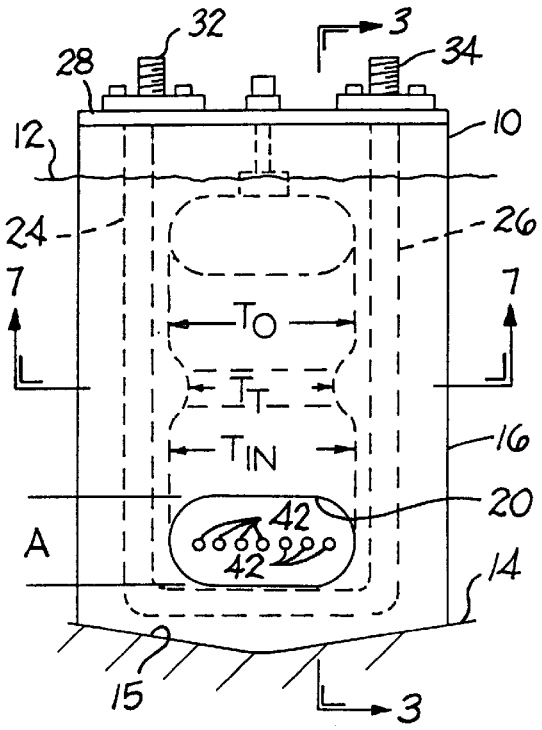
FIG. 2 is an elevational view of a monolithic jet column reactor, mounted in a pot of molten metal.
Figure 3:
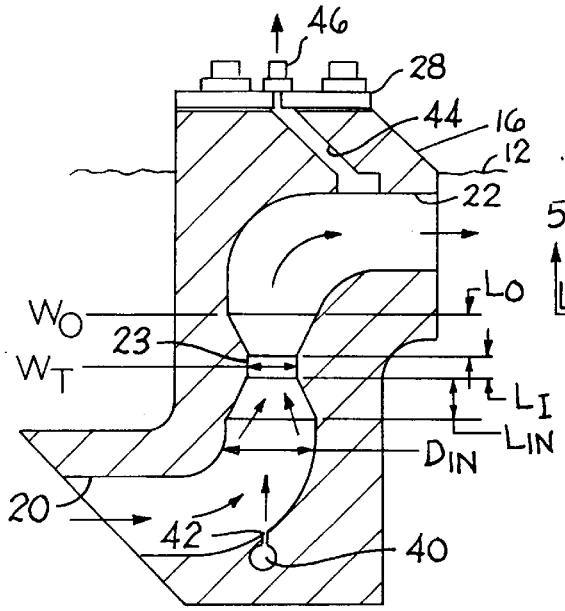
FIG. 3 is a sectional view as seen along lines 3—3 of FIG. 2.
Figure 4:
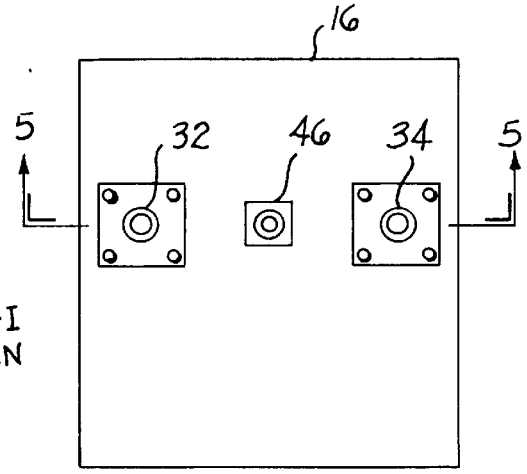
FIG. 4 is a plan view of the reactor of FIG. 2.
Figure 5:
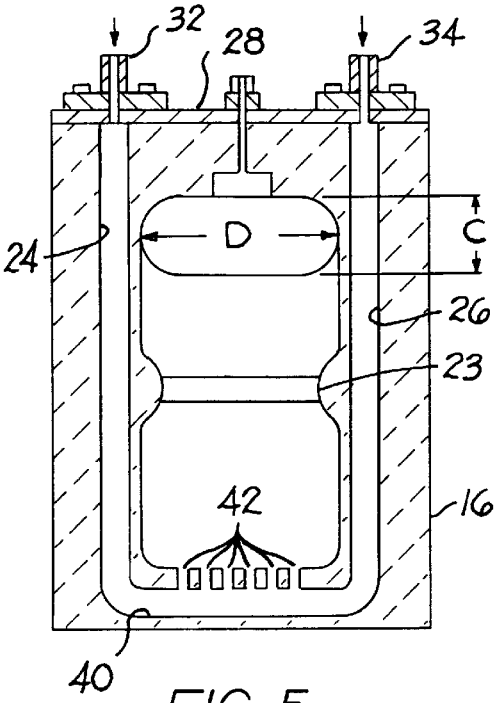
FIG. 5 is a sectional view as seen along lines 5—5 of FIG. 4.

Referring to the drawings, FIGS. 2–4 illustrate a monolithic jet column reactor 10 illustrating the invention mounted in a bath 12 of a molten metal contained in a pot partially shown at 14. Pump 10 is mounted in the bottom of the pot, preferably over a channel 15 for collecting bottom dross that tends to concentrate in the lower bottom part of the pot.

Figure 6:
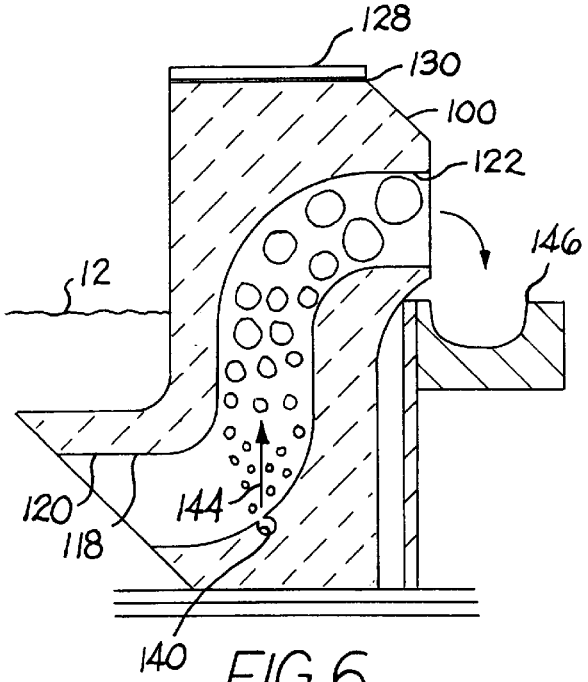
FIG. 6 is a sectional view as seen along lines 6—6 of FIG. 1.
Figure 7:
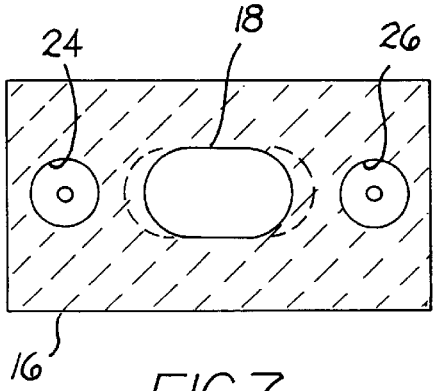
FIG. 7 is a view as seen along lines 7—7 of FIG. 2.

The jet column reactor comprises a cast refractory block 16 having an internal molten metal-lifting passage 18 as best illustrated in FIG. 6. The metal-lifting passage has a generally elliptical cross section with a lower horizontal inlet opening 20 and an upper horizontal discharge or outlet opening 22 and a vertical midsection. For illustrative purposes and referring to FIG. 2, the metal-lifting passage has a shorter dimension A of 3.5" and a width B of 7.0".

The vertical mid-section is constricted with a converging/diverging nozzle shape where the following approximate ratios exist:

$$W_T = .90W_{in} \text{ to } .60W_{in}$$

$$W_{in} = \frac{3.50 \text{ in}}{4.50 \text{ in}};$$

$$L_{in} = \frac{.60W_{in}}{.80W_{in}};$$

$$L_1 = \frac{.30W_{in}}{.50W_{in}};$$

and $$L_0 = \frac{16.0_{in}}{20.0_{in}} \cdot W_0 = W_{in}$$

The refractory block also has a pair of vertical gas-receiving passages 24 and 26 disposed on opposite sides of the metal-lifting passage. The gas-receiving passages extend to the top of the block. A holding plate 28 is attached to the top of the block on a gasket 30 to prevent the gas from leaking around the holding plate. A pair of threaded metal nipples 32 and 34 having internal passages 36 and 38 are connected to passages 24 and 26, respectively, and adapted to be connected to a source of pressurized gas such as nitrogen, argon, or helium. For illustrative purposes, nitrogen is introduced to the nipples.

The lower end of passages 24 and 26 extend down in the block adjacent a position below the jet metal-lifting passage.

A horizontal passage 40 connects the lower end of the two passages 24 and 26. A plurality of small horizontally spaced (gas injecting nozzles) orifices or openings 42 connect passage 40 with metal-lifting passage 18. Preferably each opening 42 has a diameter of 0.030" to 0.100" to form a gas jet into the nozzle section of the metal-lifting passage. In all cases the gas is delivered in a direction along the axis of the midsection of the passage, that is, parallel to the motion of the molten metal. It is to be noted that outlet opening 22 is disposed beneath the top metal line of molten metal 12.

Referring to FIG. 3, a top gas recovery passage 44 extends from the top horizontal portion of the metal-lifting passage to an outlet nipple 46.

The embodiment of FIGS. 2–5 illustrates a linerless jet column reactor.

Figure 11:
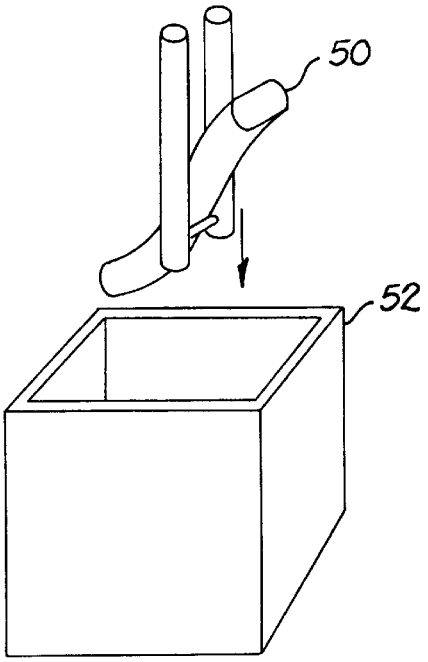
FIG. 11 illustrates a wax pattern being lowered into a box.
Figure 12:
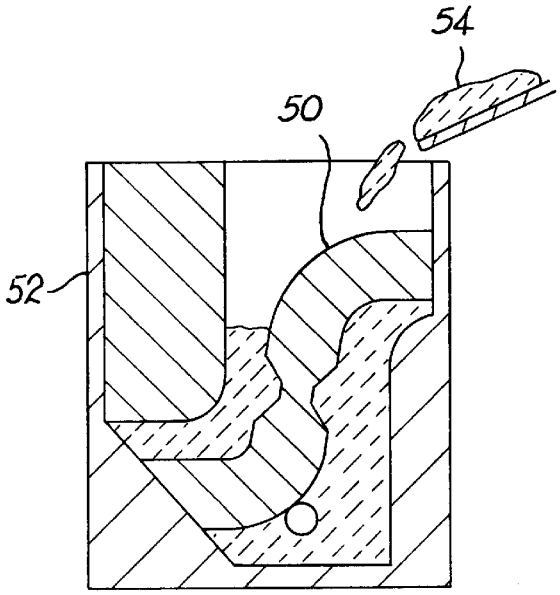
FIG. 12 illustrates refractory mix being disposed in the box of FIG. 11 to surround and cover the wax pattern.
Figure 13:
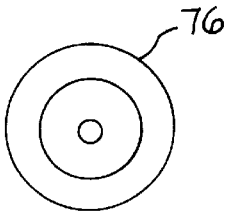
FIGS. 13 and 14 illustrates a typical gas inlet ceramic insert that defines the gas nozzles.
Figure 14:
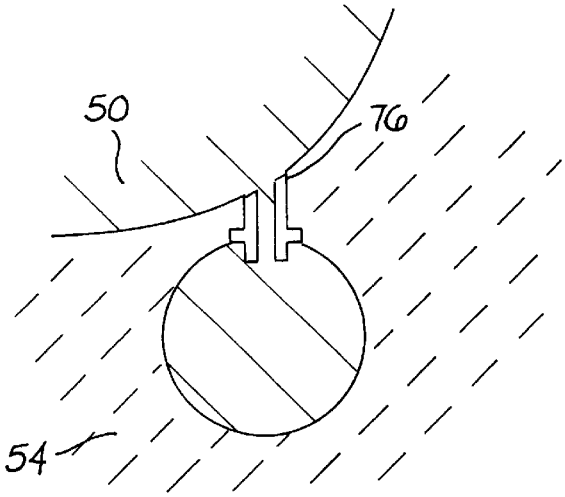

Referring to FIGS. 11, 12, and 13, preferably the jet column reactor is made by initially forming a wax pattern 50 having the configuration of the gas passage and the metal-lifting passage. The pattern is lowered into a refractory box 52. The box is filled with a refractory mix 54. The box is then inserted in a suitable furnace and heated to melt the wax and to dry and harden the refractory mix. The wax is any suitable wax used in the investment casting process. The refractory mix may be a high purity alumina castable available from K-Industrial Corporation. The kiln is heated to a temperature of 300° F. to 600° F. for a period of 12 hours in a nitrogen atmosphere to form a heat resistant refractory block, or in accordance with the suppliers curing procedure.

Figure 10:
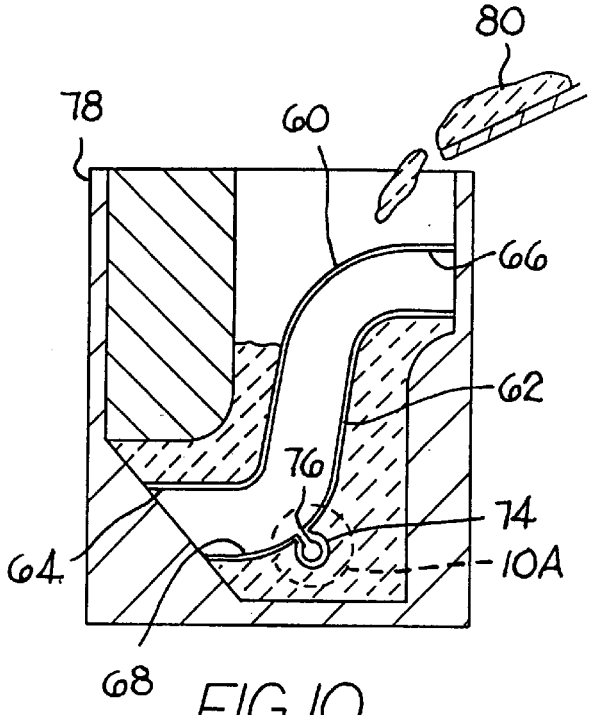
FIG. 10 illustrates the mold box being filled with refractory mix prior to being cured in a furnace.
Figure 10A:
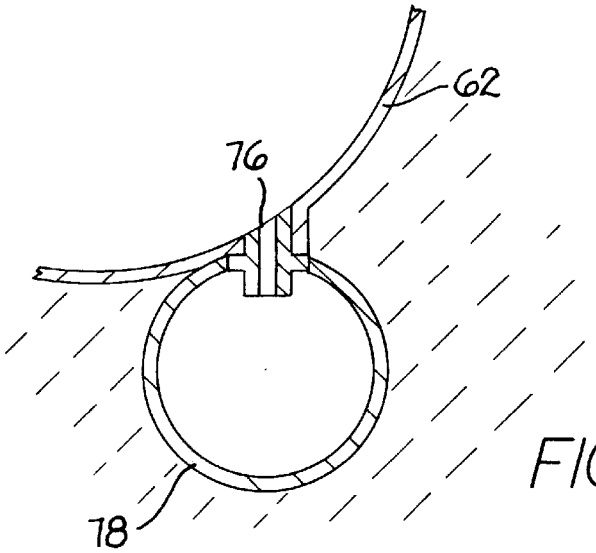
FIG. 10A is an enlarged view of the gas nozzle shown in FIG. 10.

FIG. 10 illustrates another embodiment of the invention in which the interior gas-receiving and jet gas metal-lifting passages are formed by a thin shelled ceramic pattern 60 which may be obtained from Alphatech, Inc. of Trenton, Mich. Pattern 60 has a generally S-shaped thin walled jet gas metal-lifting conduit 62 having a lower inlet opening 64 and an upper outlet opening 66. Conduit 62 forms a metal-lifting passage 68 having an elliptical cross section shown in FIG. 5. The metal-lifting passage may take other configurations.

A pair of thin walled vertical gas-receiving tubes 70 and 72 are attached to opposite sides of conduit 62 and are fluidly connected together by a short horizontal tube 74 which receives a gas from tubes 70 and 72. Tube 74 has a series of small nozzle orifices 76 for delivering the gas into the jet gas metal-lifting passage.

Each orifice 76 is placed between the metal-lifting conduit and the nitrogen gas carrying conduit to provide the accurate selected nozzle diameter configuration required for the particular application. The diameter of these nozzles is a function of the metal flow expected from the reactor, the inlet pressure available, molten metal column, etc., and is sized to obtain sonic flow velocity at optimum operating performance. Subsonic and pulsating sonic flows can also be applied when lower flows or intermittent flows are required.

Pattern 60 is inserted in a refractory box 78. A refractory mix 80 is tamped or vibrated into the box around the pattern to a level higher than the pattern. The refractory and pattern are then inserted in a suitable furnace and cured in accordance with the refractory manufacturer's procedure or at least for a period of 12 hours in a nitrogen atmosphere at 300° F. to 600° F. When the heating step has been completed, the box is removed from the furnace with the hard monolithic block forming the finished product. The ceramic pattern then forms a permanent liner for both the metal-lifting passage and the gas-receiving passages, providing a hard surface that resists erosion from cavitation and flow forces of the molten metal.

Figure 1:
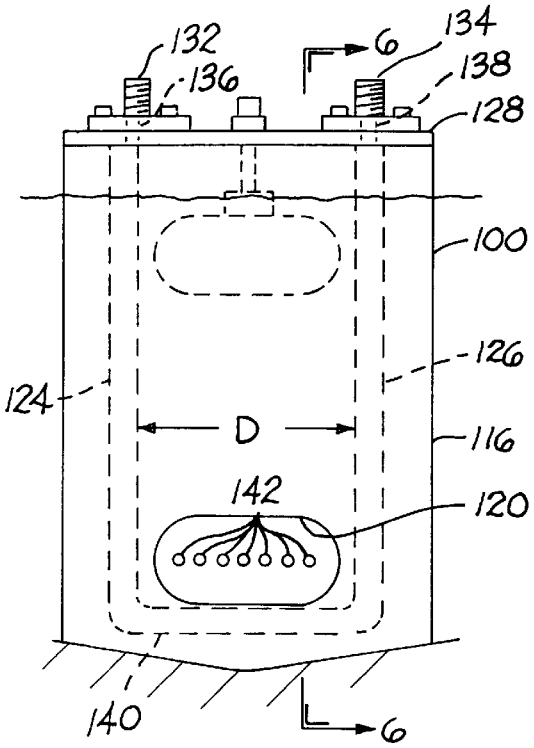
FIG. 1 is an elevational view of a monolithic bubble lifting pump, illustrating the invention mounted in a pot of metal.

Referring to the drawings, FIGS. 1 and 6 show a monolithic jet gas-lifting pump 100 mounted in bath 12 of a molten metal contained in a pot partially shown at 14. Pump 100 comprises a cast refractory block 116 having an internal metal-lifting passage 118 as best illustrated in FIG. 6. The metal-lifting passage has a generally elliptical cross section with a lower inlet opening 120 and an upper discharge or outlet opening 122. For illustrative purposes the metal-lifting passage has a short dimension of 3½" and a width D of 7".

Refractory block 116 also has a pair of vertical gas-receiving passages 124 and 126 disposed on opposite sides of the metal-lifting passage. The gas-receiving passages extend to the top of the block. A holding plate 128 is attached to the top of the block on a gasket 130 to prevent the gas from leaking around the holding plate. A pair of threaded metal nipples 132 and 134 having internal passages 136 and 138 are connected to passages 124 and 126 and adapted to be connected to a source of pressurized gas such as nitrogen, argon, or helium. For illustrative purposes, nitrogen is introduced to the nipples. The lower ends of passages 124 and 126 extend down in the block adjacent a position below the metal-lifting passage.

A horizontal passage 140 fluidly connects the lower ends of the two passages 124 and 126. A plurality of small horizontally spaced orifices or openings 142 connect passage 140 with the metal-lifting passage. Preferably each opening 142 has a diameter of 0.030±0.100" to generate a central and axial gas jet that in mixing with the metal forms a cascade of extremely small gas bubbles in the metal-lifting passage. It is to be noted that outlet opening 122 is disposed beneath the top metal line of molten metal 12.

Referring to FIG. 6, pump 100 may be mounted in a pot such that the inlet end is adjacent the bottom of the pot for lifting the dross, and the outlet end is disposed above a trough 146 to remove the dross from the pot.

When the pump is disposed with the outlet end beneath the metal line of the bath, the pump can then be employed to circulate the dross through the bath thereby preventing it from concentrating in the bottom of the pot to a level where it interferes with the other components of the galvanizing apparatus such as the lifting roll.

Figure 8:
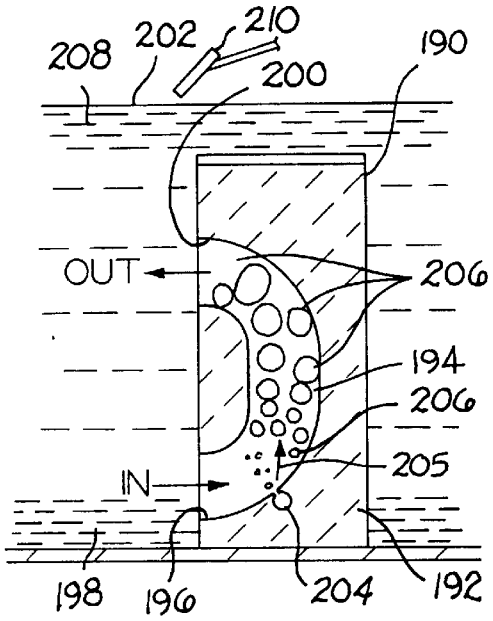
FIG. 8 is a view of another embodiment of the invention disposed in a pot of molten metal (the "C" shaped configuration)
Figure 9:
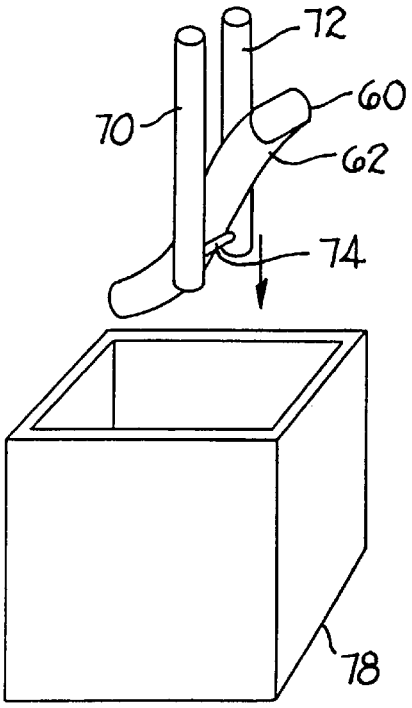
FIG. 9 is a view illustrating a thin-walled pattern being inserted in a mold box.

FIG. 8 illustrates still another embodiment of the invention. In this case a jet gas-lifting pump 190 is formed with a ceramic block 192 having a C-shaped molten metal-lifting passage 194. Passage 194 has a lower inlet opening 196 adjacent the bottom dross 198 generally illustrated in FIG. 8 with the denser section lines. The metal-lifting passage also has an outlet end 200.

In this form of the invention, both openings of the molten metal-lifting passage face in the same direction with the outlet opening being near metal line 202 of the bath. The nitrogen fed through the gas-receiving passage 204 is discharged into the molten metal-lifting passage to form high velocity jets centrally located for discharging the gas in the axial direction of arrow 205 to generate cascades of extremely small bubbles 206 which are spaced so as to progressively lift sections of metal upwardly. Since the inlet end is disposed adjacent the bottom of the pot, the bottom dross will then mix with the nitrogen and become so emulsified that it floats toward the top of the bath to form a top dross 208, represented by denser section lines in FIG. 8. The top dross can then be skimmed or removed from the bath by a skimming device 210. For illustrative purposes the bottom dross may be composed of aluminum-iron which is disposed in a bath of aluminum. The emulsified dross being lighter than the bottom dross can easily be raised in the bath by the preferred jet gas-lifting pump or the preferred jet column reactor pump of FIG. 3, if large amounts must be pumped. The same emulsifying process can be achieved by using the jet gas-lifting pump of FIG. 8 for applications requiring lower flows or velocities.

Figure 26:
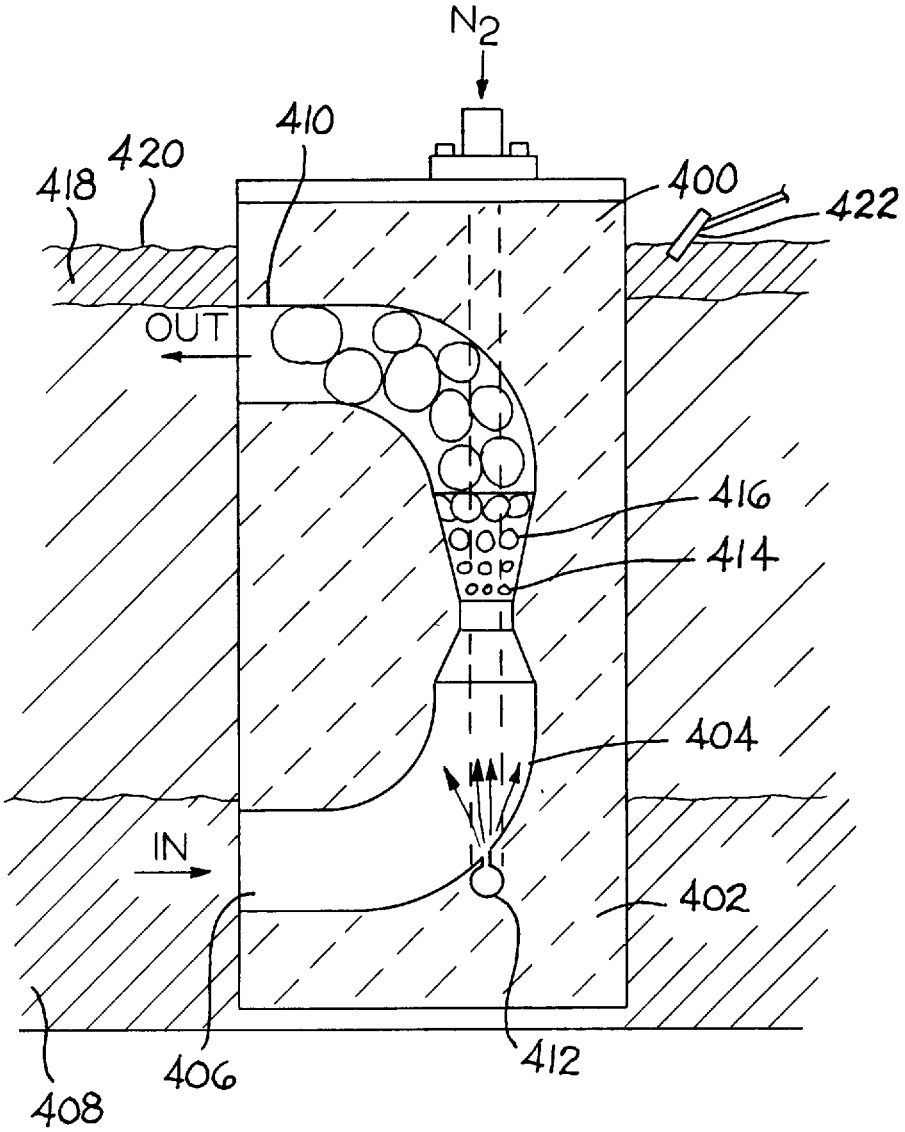
FIG. 26 is a sectional view of a "C" shaped jet column reactor.

Referring to FIG. 26, the "C" configuration can also be made as a jet column reactor by adding a convergent/divergent configuration to the metal-lifting passage.

The convergent/divergent nozzle will have similar area ratios as in the "S" configuration of FIG. 6. This will include the benefit of high gas dispersion and high efficiency degassing.

Figure 16:
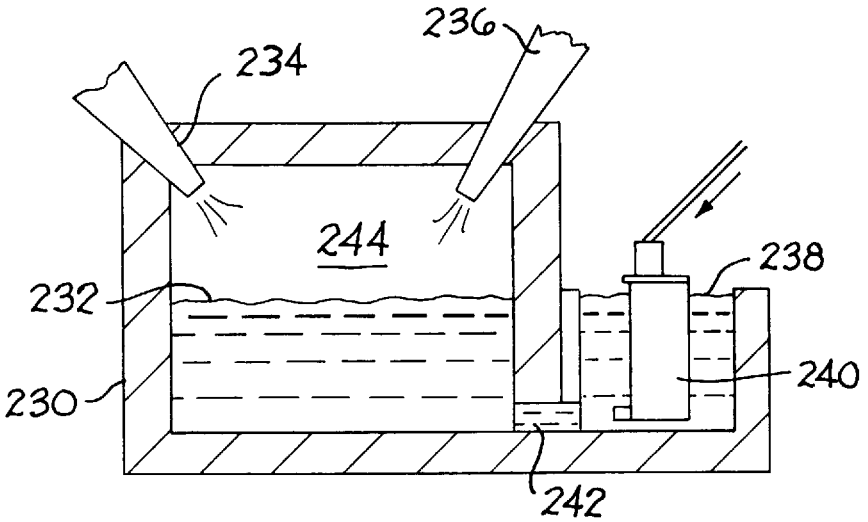
PRIOR ART FIG. 16
FIG. 16 is a fragmentary view showing a prior art furnace with an external well for receiving the metal into the pot.

FIG. 16 shows the conventional method for recycling metals such as aluminum in a furnace 230 in which molten metal 232 is heated by a pair of gas burners 234 and 236. The metal is introduced to the furnace through an open topped well 238. A pump 240 circulates the metal from the well 238 through a passage 242 to the enclosed area 244 of the furnace. The temperature variations are rather substantial in this type of furnace as well as the space requirements to accommodate the outside well.

Figure 15:
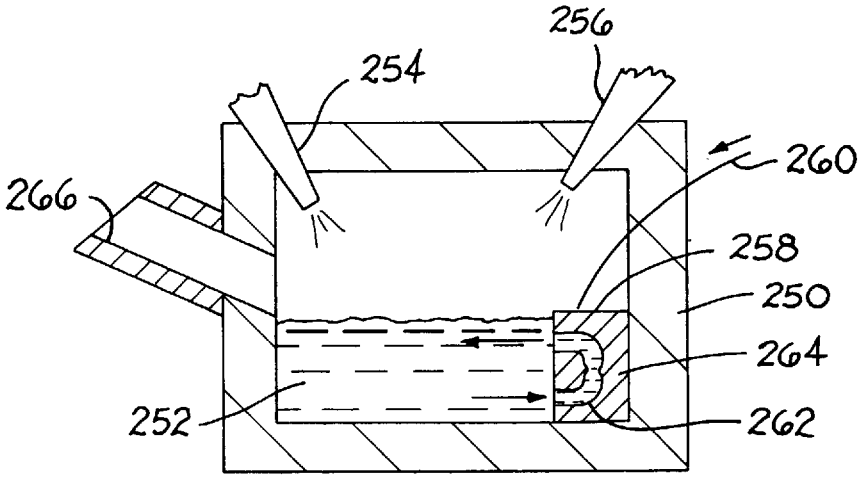
FIG. 15 illustrates a proposed furnace with internal metal recirculation and degassing.

FIG. 15 illustrates another embodiment of my invention in which a furnace 250 holds molten metal 252 which is heated by a pair of gas burners 254 and 256.

A jet reactor pump 258 is mounted in the molten metal for circulating the metal in the bath as well as degassing the molten metal. This reactor may be of the type illustrated in FIG. 26 with a convergent/divergent nozzle. The gas, supplied from a source 260, is delivered to the metal transfer passage 262 for recirculating the metal through a cast ceramic or refractory block 264. This arrangement permits the metal that is to be recycled to be loaded through a funnel 266 thereby eliminating the need for an outside well as well as providing a more compact pump with no moving parts as opposed to the pumps used in the existing practice.

Figure 23:
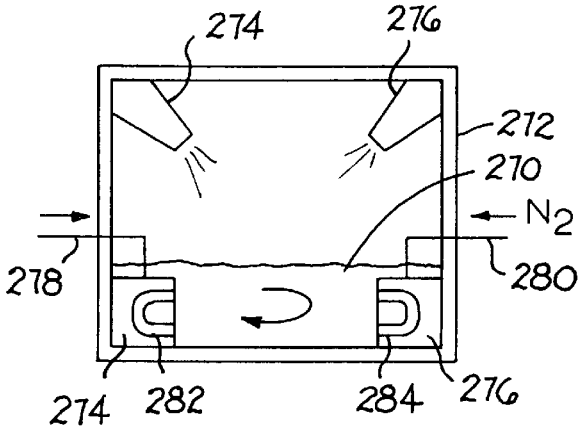
FIG. 23 is an elevational schematic view showing the manner in which a pair of refractory pumps can be employed for circulating the metal in a pot.
Figure 24:
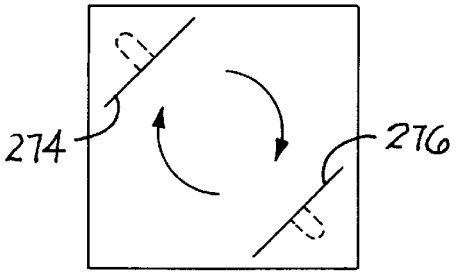
FIG. 24 is a plan view of the embodiment of FIG. 23 showing the location of the two pumps.
Figure 25:
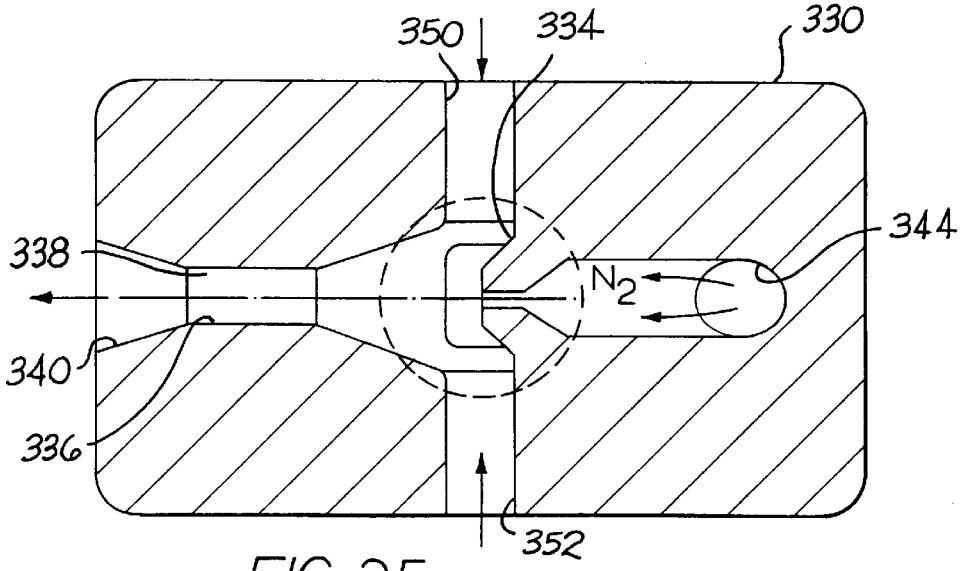
FIG. 25 is a view as seen along lines 25—25 of FIG. 21.

FIGS. 23 and 24 illustrate another similar arrangement in which a bath of molten metal 270 is heated within a furnace 272. A pair of gas nozzles 274 and 276 provide means for heating the molten metal. A pair of jet reactor pumps 274 and 276 are mounted at opposite corners of the furnace as illustrated in FIG. 24. The reactor pumps are supplied with a source of a gas at 278 and 280, respectively, for circulating the molten metal through a pair of C-shaped metal transfer passages 282 and 284 respectively. This arrangement provides an effective and convenient means for circulating the molten metal in order to maintain a homogeneous temperature as well as for degassing the molten metal.

Figure 17:
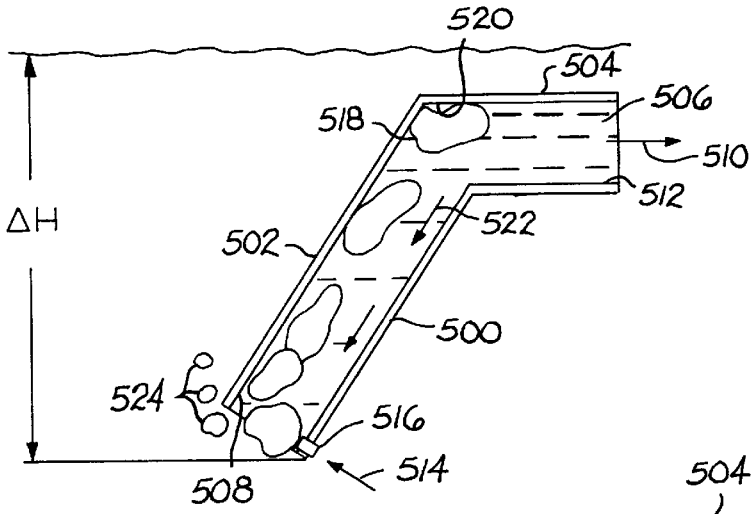
FIGS. 17 and 18 illustrate the problems inherent in discharging a gas into a metal transfer passage in a direction at right angles to the metal flow.
Figure 18:
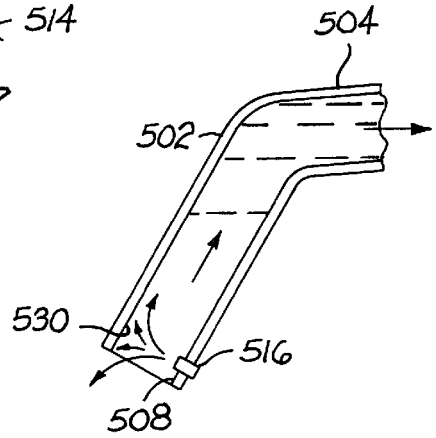

FIGS. 17 and 18 illustrate the prior art thin walled type of conduits described in the Areaux patents for transferring molten metal using the type of bubble lifting technology. FIG. 17 shows a conduit 500 having an inclined section 502 and a horizontal section 504. The molten metal 506 is intended to be received through a bottom inlet opening 508 and delivered in the direction of arrow 510 through a top discharge or outlet opening 512. The transfer of the metal is induced by a source of gas 514 received through a bottom nozzle 516. Source 514 delivers the gas at right angles to the longitudinal axis of the conduit, not in the upward intended motion of the molten metal.

This arrangement provides several inefficiencies and defects in the performance of such a pump. For example, a gas such as nitrogen forms a bubble upon leaving nozzle 516. The bubble tends to elongate as it rises in the conduit. As the bubble rises, it tends to cause cavitation damage at turns in the conduit such as at 520 where the molten metal and bubbles change direction. This reduces the life of a thin walled conduit.

Further, the bubbles must be formed one at a time or they become so large as to restrict the metal flow by discharging in the direction of arrow 524. Because of the inclined tube, some of the metal flows downwardly (backflow) in the direction of arrow 522 toward inlet opening 508. Further, if the gas inlet pressure is increased in order to increase the metal flow, the bubbles suddenly enlarge forcing some of the gas to back up through the tube's lower opening (pump inlet) as illustrated at 524, restricting the metal from entering the tube.

Further, gas delivered through nozzle 516 at a supersonic velocity at right angles to the longitudinal axis of the motion of the metal in the conduit will quickly erode and destroy the conduit at 530, opposite the nozzle, also extremely reducing the life of a thin walled conduit.

Figure 19:
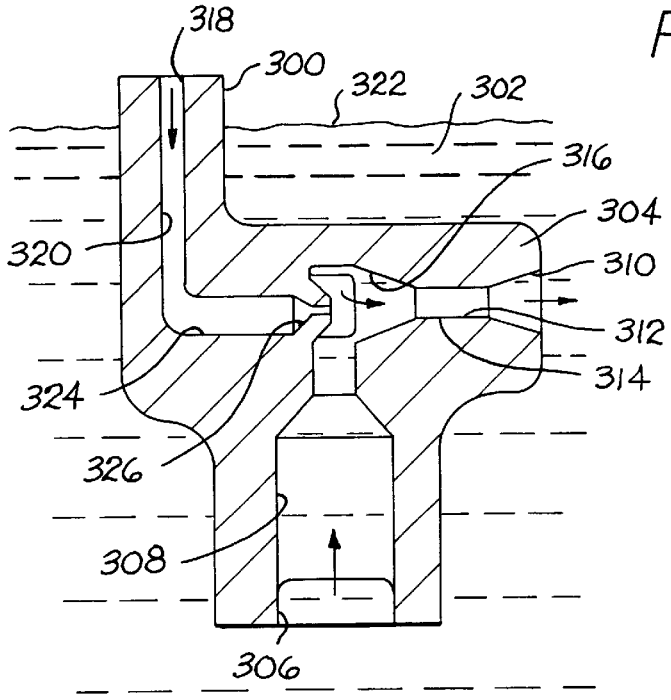
FIG. 19 is a view of a preferred jet pump disposed in a pot of molten metal for drawing the metal upwardly from the bottom of the pot.
Figure 20:
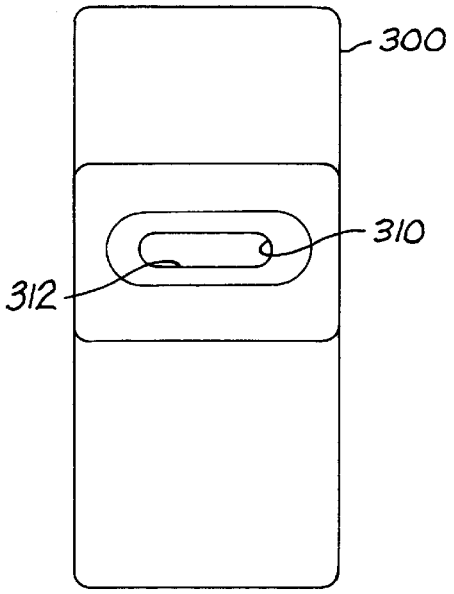
FIG. 20 is a view as seen from the right side of the FIG. 19.

FIGS. 19 and 20 illustrate another embodiment of the invention for reducing the problems illustrated in FIGS. 17 and 18. FIG. 19 illustrates a jet pump 300 mounted in a pool of molten metal 302. The jet pump has a cast ceramic or refractory body 304 cast in accordance with the invention with a bottom molten metal inlet opening 306 and a vertical passage 308 for receiving molten metal, and a convergent/divergent nozzle with a funnel shaped outlet opening 310 for discharging the molten metal. The metal passes through a horizontal passage 312 from the inlet opening to the outlet opening. Passage 312 has a convergent/divergent section 314 which assists in retarding the rate at which the gas bubbles enlarge.

The upper end of passage 308 and the inner end of passage 312 terminate at a mixing chamber 316.

An inert gas such as nitrogen, is received through an upper opening 318 into a vertical gas passage 320.

The upper portion of the pump body is above metal line 322 of the molten metal.

Gas passage 320 terminates in a horizontal passage 324 which in turn is connected to a nozzle 326 which delivers gas in a horizontal direction to impinge upon the molten metal in chamber 316 and thereby induce its motion in a horizontal direction toward outlet opening 310. This arrangement has several advantages over the arrangement illustrated in FIGS. 17 and 18. For example, there is no thin walled structure, that can be easily eroded from the gas.

The gas is delivered horizontally toward the center of outlet passage 312, and it does not directly impinge against the wall of the passage causing cavitation. Further, the jet pump does not depend upon the head of the molten metal as is required for a bubble type of pump which requires a head in order for the bubbles to rise. Further, the discharge conduit 314 can be in a horizontal position, whereas the conduits of FIGS. 17 and 18 cannot function without an inclined passage permitting the bubbles to rise to induce the molten metal flow.

Figure 21:
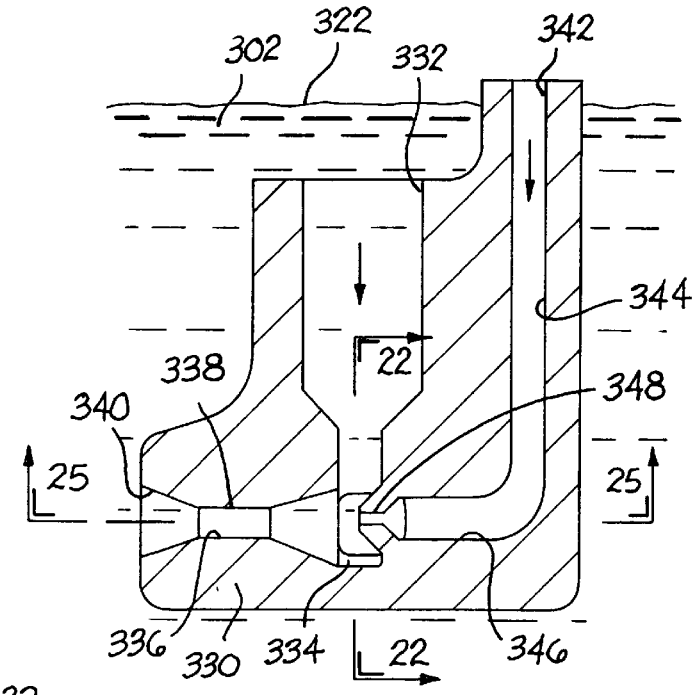
FIG. 21 is a view of another jet pump similar to the embodiment of FIG. 19, but in which the metal is drawn downwardly into the pump.
Figure 22:
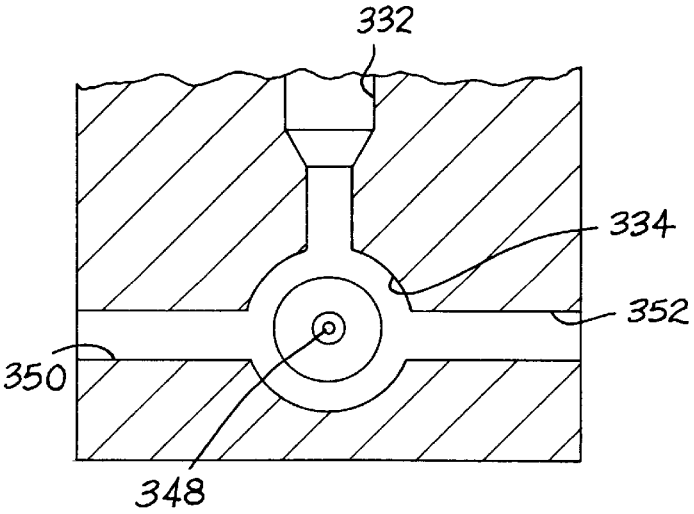
FIG. 22 is a view generally as seen along lines 22—22 of FIG. 21.

FIGS. 21 and 22 illustrate another version of the jet pump of FIG. 19. In this case, a cast ceramic or refractory pump body 330 formed in accordance with the invention is disposed in molten metal 302. The pump body has a top molten metal inlet opening 332 which terminates at its lower end in a mixing chamber 334. An outlet passage 336 having a convergent/divergent section 338 to retard bubble elongation, has its inner end connected with chamber 334.

The opposite end of passage 336 passes the metal toward a molten metal outlet opening 340.

A source of nitrogen gas is delivered through a gas passage inlet opening 342 down through a vertical passage 344 to a horizontal passage 346 which is axially aligned passage 336. Passage 346 terminates with a nozzle 348 which delivers the nitrogen gas such that it impinges upon the molten metal passing down into the mixing chamber, and then induces it to flow horizontally through the center of passage 336 toward the outlet opening. This embodiment illustrates how the molten metal inlet passage can be disposed at any suitable angle for recirculating the molten metal and/or while simultaneously degassing the molten metal. It further provides means for mixing cooler portions of the molten metal with hotter metal in order equalize the metal temperature.

FIG. 22 is an enlarged view of the mixing chamber and shows how the molten metal is introduced to mixing chamber 334 received from vertical passage 332 and a pair of horizontal passages 350 and 352. This embodiment illustrates how the molten metal can be introduced to the metal transfer conduit from any direction. It is independent of and does not require an inclined conduit.

FIG. 26 illustrates another embodiment of the invention. In this case, a jet column reactor-lifting pump 400 is formed of a ceramic block 402 having a C-shaped molten metal-lifting passage 404. Passage 404 has a lower inlet opening 406 adjacent the bottom dross 408 illustrated in FIG. 26 with the denser section lines. The metal-lifting passage has an upper outlet opening 410. In this form of the invention, like that of the embodiment of FIG. 8, both openings of the metal-lifting passage face the same direction as the outlet opening. Nitrogen is fed through a gas-receiving passage 412 into the molten metal-lifting passage to form high velocity jets that are centrally located for discharging the gas into a convergent/divergent nozzle 414 to generate a cascade of extremely small bubbles 416. Each bubble coalesces into larger bubbles as a function of the nozzle configuration. Since the inlet opening is disposed adjacent the bottom of the pot, the bottom dross will then mix with the nitrogen and become so emulsified that it floats towards the top of the bath to form a top dross 418, presented by the denser section lines in FIG. 26. The top dross can then be skimmed or removed from the metal line 420 of the bath by a skimming device 422.

Having described my invention, I claim:

1. In a metal treating apparatus having a pot for holding a bath of molten metal, transfer means for moving the molten metal in the pot, including a molten metal-lifting passage having a molten metal inlet opening disposed in the pot for receiving molten metal therein; the metal-lifting passage having a molten metal outlet opening for discharging molten metal received in the inlet opening to a location above the inlet opening; the metal-lifting passage having a gas-receiving opening below the molten metal outlet opening; gas passage means for connecting a source of the gas to the gas receiving opening in the metal-lifting passage such that the gas passes along the metal-lifting passage to induce a flow of metal from the molten metal inlet opening towards the molten metal outlet opening, the improvement comprising:

a monolithic cast refractory block having a planar bottom portion, a top portion, and side portions extending between the top and bottom portions, said molten metal-lifting passage having an inlet opening extending into the monolithic cast refractory block from one of the side portions proximate to the bottom portion, and an outlet opening extending from within the monolithic cast refractory block through one of the side portions proximate to the top portion, the inlet opening and the outlet opening being joined by a metal-lifting passage extending within the monolithic cast refractory block.

2. The improvement as defined in claim 1, including a ceramic liner disposed in the metal-lifting passage.

3. The improvement as defined in claim 1, in which the metal-lifting passage has a generally S-shaped configuration from the lower inlet opening to the upper outlet opening, and the lower inlet opening is disposed on the opposite side of the block as the outlet opening.

4. The improvement as defined in claim 1, in which the metal-lifting passage has a generally C-shaped opening whereby the molten metal inlet opening and the metal outlet opening are disposed on the same side of the block.

5. The improvement as defined in claim 1, in which the molten metal inlet opening and the molten metal outlet opening face in different directions.

6. The improvement as defined in claim 1, in which the gas passage means includes a gas-receiving conduit, and a plurality of gas openings connecting the gas-receiving conduit with the metal-lifting passage to provide a gas jet creating a cascade of very small rising bubbles for raising the molten metal in the metal-lifting passage.

7. The improvement as defined in claim 1, in which the metal-lifting passage has an elliptical cross-section.

8. The improvement as defined in claim 1, in which the metal-lifting passage has a convergent/divergent nozzle between the inlet opening and the outlet opening to suppress the enlargement of bubbles formed in the gas passing along the metal-lifting passage.

9. The improvement as defined in claim 1, in which the metal-lifting passage is elongated and the gas is introduced in a direction along the longitudinal axis of the metal-lifting passage.

10. The improvement as defined in claim 1, in which the gas passage means includes a plurality of spaced gas orifices disposed about the metal-lifting passage.

11. The improvement as defined in claim 1, including a gas recovery passage having an inlet opening adjacent the outlet opening of the metal-lifting passage for passing gas removed from the molten metal.

12. In a metal treating apparatus having a pot for holding a bath of molten metal, transfer means for moving the molten metal in the pot, including a molten metal-lifting passage having a molten metal inlet opening disposed in the pot for receiving molten metal therein; the metal-lifting passage having a molten metal outlet opening for discharging molten metal received in the inlet opening to a location above the inlet opening; the metal-lifting passage having a gas-receiving opening below the molten metal outlet opening; gas passage means for connecting a source of the gas to the gas receiving opening in the metal-lifting passage such that the gas passes along the metal-lifting passage to induce a flow of metal from the molten metal inlet opening towards the molten metal outlet opening, the improvement comprising:

the refractory block being formed by making a pattern of the metal-lifting passage and the gas passage means, placing the pattern in a refractory-receiving box, filling the box to a depth sufficient to cover the pattern with a castable refractory mix, melting the pattern to form the metal-lifting passage and the gas passage means, and then heating the refractory in a kiln to form a heat resistant casting.

13. In a metal treating apparatus having a pot for holding a bath of molten metal, transfer means for moving the molten metal in the pot, including a molten metal-lifting passage having a molten metal inlet opening disposed in the pot for receiving molten metal therein; the metal-lifting passage having a molten metal outlet opening for discharging molten metal received in the inlet opening to a location above the inlet opening; the metal-lifting passage having a gas-receiving opening below the molten metal outlet opening; gas passage means for connecting a source of the gas to the gas receiving opening in the metal-lifting passage such that the gas passes along the metal-lifting passage to induce a flow of metal from the molten metal inlet opening towards the molten metal outlet opening, the improvement comprising:

the cast refractory block being formed by making a thin walled ceramic pattern of the metal-lifting passage and the gas passage means, placing the pattern in a refractory receiving box; filling the box to a depth sufficient to cover the pattern with a castable refractory mix; and then heating the refractory in a kiln to form a heat resistant casting.

14. A jet gas reactor device for moving molten metal in a pot of such metal comprising a cast refractory block having a metal-moving passage with a molten metal inlet opening, a molten metal outlet opening, and a convergent/-divergent nozzle between the inlet opening and the outlet opening, the metal-moving passage having a gas-receiving opening between the inlet opening and the convergent/divergent nozzle, and a gas passage means for connecting a source of a pressurized gas to the gas-receiving opening in the metal-moving passage such that the gas passes through the convergent/divergent nozzle to induce a low of molten metal from the molten metal inlet opening toward the molten metal outlet opening.

15. In a furnace having a pot holding a bath of molten metal:

a first cast refractory pump having a molten metal inlet opening disposed in the pot for receiving molten metal therein, a molten metal transfer passage having a molten metal outlet opening for discharging the molten metal received in the inlet opening, gas passage means for connecting a source of a gas to the metal transfer passage such that the gas passes along the molten metal transfer passage to induce a flow of metal from the molten metal inlet opening towards the molten metal outlet opening;

a second cast refractory pump having a molten metal transfer passage with a molten metal inlet opening disposed in the pot for receiving molten metal therein, the molten metal transfer passage having a molten metal outlet opening for discharging molten metal received in the inlet opening, gas passage means for connecting a source of a gas to the molten metal transfer passage such that the gas passes along the molten metal transfer passage to induce a flow of metal from the molten metal inlet opening towards the molten metal outlet opening;

each of the cast refractory pumps comprising a monolithic cast refractory block having a planar bottom portion, a top portion, and side portions extending between the top and bottom portions, said molten metal-lifting passage having an inlet opening extending into the monolithic cast refractory block from one of the side portions proximate to the bottom portion, and an outlet opening extending from within the monolithic cast refractory block through one of the side portions proximate to the top portion, the inlet opening and the outlet opening being joined by a metal-lifting passage extending within the monolithic cast refractory block; and the second cast refractory pump being spaced from the first refractory pump in the pot whereby the two cast refractory pumps cooperate in circulating the molten metal in the pot.

16. In a molten metal treating apparatus including a pot for holding a bath of molten metal, transfer means for moving the molten metal in the pot, including a molten metal transfer passage having a molten metal inlet opening disposed in the pot for receiving molten metal therein, the metal transfer passage having a molten metal outlet opening for discharging the molten metal received in the inlet opening, gas passage means for connecting a source of a gas to the molten metal transfer passage, such that the gas passes toward the outlet opening to induce a flow of metal from the molten metal inlet opening toward the molten metal outlet opening, the improvement comprising:

the gas passage means including a gas ejector nozzle for impinging gas into molten metal in the molten metal transfer passage to move the molten-metal from the inlet opening toward the outlet opening.

17. A monolithic cast refractory block having a planar bottom portion, a top portion, and side portions extending between the top and bottom portions, an inlet opening extending into the monolithic cast refractory block from one of the side portions proximate to the bottom portion, and an outlet opening extending from within the monolithic cast refractory block through one of the side portions proximate to the top portion, the inlet opening and the outlet opening being joined by a metal-transfer passage extending within the monolithic cast refractory block;

gas passage means for connecting a source of a gas to the metal transfer passage such that the gas passes toward the outlet opening to induce a flow of metal from the metal inlet opening toward the metal outlet opening;

the metal transfer passage having a convergent/divergent nozzle for passing molten metal, and the gas passage means including a gas ejector nozzle for impinging gas upon the molten metal to move the metal toward the convergent/divergent nozzle and the outlet opening.

18. A method for conveying molten metal from a first location to a second location in a molten metal pool, comprising the steps of:

providing an elongated metal transfer conduit having a molten metal inlet opening and a molten metal outlet opening;

providing a gas feed means, and connecting the gas feed means to the metal transfer conduit to induce a flow of molten metal along an axis of metal movement in the metal transfer conduit by means of the gas passing from the gas feed means into the metal transfer conduit; and delivering the gas from the gas feed means through an opening in the metal transfer conduit located along said axis into molten metal in the metal transfer conduit.

19. In a container for holding a liquid, transfer means for moving the liquid in the container, including a liquid-moving passage having a liquid inlet opening disposed in the container for receiving liquid therein; the liquid-moving passage having a liquid outlet opening for discharging liquid received in the inlet opening; the liquid-moving passage having a gas-receiving opening; gas passage means for connecting a source of the gas to the gas-receiving opening in the liquid moving passage such that the gas passes along the liquid-moving passage to induce a flow of liquid from the liquid inlet opening towards the liquid outlet opening, the improvement comprising:

the transfer means comprising a monolithic cast refractory block having a planar bottom portion, a top portion, and side portions extending between the top and bottom portions, said liquid-moving passage having an inlet opening extending into the monolithic cast refractory block from one of the side portions proximate to the bottom portion, and an outlet opening extending from within the monolithic cast refractory block through one of the side portions proximate to the top portion, the inlet opening and the outlet opening being joined by the liquid-moving passage extending within the monolithic cast refractory block.

20. An apparatus including a container for holding a bath of a liquid, transfer means for moving the liquid in the container, including a liquid transfer passage having a liquid inlet opening disposed in the container for receiving liquid therein, the liquid transfer passage having a liquid outlet opening for discharging liquid received in the inlet opening, gas passage means for connecting a source of a gas to the liquid transfer passage, such that a gas passes toward the outlet opening to induce a flow of liquid from the inlet opening toward the outlet opening, the improvement comprising:

the gas passage means including a gas ejector nozzle for impinging the gas upon the liquid adjacent the liquid inlet opening to mix the gas with the liquid.

21. In a metal treating apparatus including a pot for holding a bath of molten metal, transfer means for moving the metal in the pot, including a molten metal transfer passage having a molten metal inlet opening disposed in the pot for receiving molten metal therein, the metal transfer passage having a molten metal outlet opening for discharging molten metal received in the inlet opening, the improvement comprising:

a monolithic cast refractory block having a planar bottom portion, a top portion, and side portions extending between the top and bottom portions, said molten metal-transfer passage having an inlet opening extending into the monolithic cast refractory block from the top portion, and an outlet opening extending from within the monolithic cast refractory block through one of the side portions proximate to the top portion, the inlet opening and the outlet opening being joined by the metal-lifting passage extending within the monolithic cast refractory block;

a convergent/divergent nozzle disposed in the metal transfer passage; and gas jet reactor means for ejecting gas into the metal transfer passage toward the convergent/divergent nozzle into metal passing toward the molten metal outlet opening.

22. In an apparatus including a container for holding a bath of a liquid transfer means for moving the liquid in the container, including a liquid transfer passage having a liquid inlet opening disposed in the container for receiving liquid therein, the liquid transfer passage having a liquid outlet opening for discharging liquid received in the inlet opening, gas passage means for connecting a source of a gas to the liquid transfer passage, such that a gas passes toward the outlet opening to induce a flow of liquid from the inlet opening toward the outlet opening, the improvement comprising:

the gas passage means including a gas ejector nozzle for impinging the gas upon the liquid adjacent the inlet opening to mix the gas with the liquid.

23. In a metal treating apparatus including a pot for holding a bath of molten metal, transfer means for moving the metal in the pot, including a molten metal transfer passage having a molten metal inlet opening disposed in the pot for receiving molten metal therein, the metal transfer passage having a molten metal outlet opening for discharging molten metal received in the inlet opening, the improvement comprising:

a monolithic cast refractory block having a planar bottom portion, a top portion, and side portions extending between the top and bottom portions, said molten metal transfer passage having an inlet opening extending into the monolithic cast refractory block from the bottom portion, and an outlet opening extending from within the monolithic cast refractory block through one of the side portions, the inlet opening and the outlet opening being joined by the metal-lifting passage extending within the monolithic cast refractory block;

a convergent/divergent nozzle disposed in the metal transfer passage; and gas jet reactor means for ejecting gas into the metal transfer passage toward the convergent/divergent nozzle into metal passing toward the molten metal outlet opening.

24. The improvement as defined in claim 17, in which the block is cast with gas passages to discharge the gas into the metal transfer passage so as to de-gas the molten metal as the metal is transferred along the metal transfer passage.

25. Apparatus as defined in claim 16, including a convergent/divergent nozzle disposed in the metal transfer passage between the gas ejector nozzle and the metal outlet opening.

26. A block as defined in claim 17, in which the block is disposed to receive metal through an upright inlet opening that is disposed above the injector nozzle.

27. A block as defined in claim 17, in which the gas metal transfer inlet opening is disposed beneath the injector nozzle whereby the molten metal is drawn upwardly toward the injector nozzle as the gas impinges upon the molten metal to induce a flow toward the metal transfer passage outlet opening.

28. A method as defined in claim 18, including reducing the pressure downstream of the gas feed means so as to inhibit the enlargement of gas bubbles as they progress from the gas feed means with the molten metal toward the metal transfer passage outlet opening.

29. The improvement as defined in claim 1, in which the pot has a trough beneath the block for collecting bottom dross.

30. The improvement as defined in claim 1, in which the gas passage means includes a plurality of spaced gas orifices disposed about the metal-lifting passage, and in which each orifice has an orifice opening for passing gas into the metal-lifting passage, each orifice opening being smaller in size than the metal-lifting passage.

31. The improvement as defined in claim 1, including a ceramic liner disposed in the metal-lifting passage; and in which the molten metal inlet opening and the molten metal outlet opening face in different directions.

32. The improvement as defined in claim 1, including a ceramic liner disposed in the metal-lifting passage; and in which the metal-lifting passage has a generally S-shaped configuration from the lower inlet opening to the upper outlet opening, and the lower inlet opening is disposed on the opposite side of the block as the outlet opening.

33. The improvement as defined in claim 1, including a ceramic liner disposed in the metal-lifting passage; and in which the metal-lifting passage has a generally C-shaped opening whereby the molten metal inlet opening and the molten metal outlet opening are disposed on the same side of the block.

34. The improvement as defined in claim 12, and in which the pattern is formed of a wax material.

35. A gas jet reactor device as defined in claim 14, in which the gas passage means is operative to discharge the gas into the metal-moving passage to degas molten metal disposed in the metal-moving passage.

36. A method as defined in claim 18, including the step of reducing the pressure downstream of the gas feed means to inhibit the enlargement of gas bubbles as they progress from the gas feed means with the molten metal toward the molten metal outlet opening.

* * * * *